US005090813A

United States Patent [19]

McFarland et al.

[11] Patent Number: 5,090,813

[45] Date of Patent: Feb. 25, 1992

[54] DUAL DRUM RECYCLE ASPHALT DRYING AND MIXING METHOD AND APPARATUS

[75] Inventors: William D. McFarland, Cedar Rapids; Joseph E. Musil, Ely, both of Iowa

[73] Assignee: Cedarapids, Inc., Cedar Rapids, Iowa

[21] Appl. No.: 556,744

[22] Filed: Jul. 23, 1990

[51] Int. Cl.[5] ..... E01C 19/10; B01F 9/06; F27B 7/34

[52] U.S. Cl. ..... 366/23; 366/25; 432/109

[58] Field of Search ..... 366/23, 24, 25, 22, 366/7, 40, 54, 56; 432/14, 16, 105, 106, 109, 111, 118; 34/28, 31, 33, 129, 131, 136, 135, 137

[56] References Cited

U.S. PATENT DOCUMENTS

| | | | |
|---|---|---|---|
| Re. 31,904 | 6/1985 | Mendenhall | 366/25 |
| 1,727,340 | 10/1926 | Flory . | |
| 3,865,541 | 2/1975 | Wilson et al. | 432/13 |
| 3,880,143 | 4/1975 | Hart et al. | 126/343.5 A |
| 3,920,380 | 11/1975 | Heian | 432/2 |
| 4,047,884 | 9/1977 | Heian | 432/21 |
| 4,190,370 | 2/1980 | Brock et al. | 366/25 |
| 4,207,062 | 6/1980 | Moench et al. | 366/25 X |
| 4,208,131 | 6/1980 | Mendenhall | 366/25 X |
| 4,211,490 | 7/1980 | Brock et al. | 366/25 X |
| 4,318,619 | 3/1982 | Schlarmann | 366/4 |
| 4,326,809 | 4/1982 | Mendenhall | 366/25 X |
| 4,332,478 | 6/1982 | Binz | 366/4 |
| 4,395,129 | 7/1983 | Musil | 366/25 |
| 4,477,250 | 10/1984 | Brashears et al. | 432/3 |
| 4,555,182 | 11/1985 | Mendenhall | 366/25 |
| 4,579,458 | 4/1986 | Ohlson | 366/23 X |
| 4,600,379 | 7/1986 | Elliott | 432/13 |
| 4,705,404 | 11/1987 | Bruggemann | 366/7 |
| 4,738,539 | 4/1988 | Marconnet | 366/25 X |
| 4,802,139 | 1/1989 | Sasaki | 366/25 X |
| 4,813,784 | 3/1989 | Musil | 366/24 |

FOREIGN PATENT DOCUMENTS

| | | | |
|---|---|---|---|
| 962406 | 9/1982 | U.S.S.R. | 366/25 |

*Primary Examiner*—Harvey C. Hornsby

*Attorney, Agent, or Firm*—Simmons, Perrine, Albright & Ellwood

[57] ABSTRACT

An asphalt drum drying and mixing plant capable of using recycled pavement aggregate material includes two interacting drums, each being heated to different temperatures. A first drum is a parallel flow drying and mixing drum. The recycled material is introduced at the intake or feed end of this first drum and dried and heated to a comparatively low temperature in a first region of the first drum. A burner of relatively lower heat generation capacity furnishes heated gases. The recycled material is protected by supplying the gases through a cylindrical combustion chamber within which the fuel is completely burned such that no luminous gases enter the drum and contact the recycled material. A second, adjacent region of the parallel flow drum is the mixing region. The recycled material is transferred to the mixing region with the close control over the temperature at which the material enters the mixing region. The parallel flow drum also has an intermediate feed chute through which virgin aggregate material is added. The virgin aggregate is heated in a counterflow drum to a temperature higher than the recycled material and the temperature of the final mix is controlled by changing the temperature of the virgin material. The exhaust from the mixing region is introduced as secondary air into the counterflow drum burner assembly. From the counterflow drum all gases are passed to a cleaning system including a cyclone separator and a baghouse filter. From the cyclone separator and the baghouse filter separated material and fines are routed into the mixing region together with liquid asphalt cement.

8 Claims, 1 Drawing Sheet

DUAL DRUM RECYCLE ASPHALT DRYING AND MIXING METHOD AND APPARATUS

BACKGROUND OF THE INVENTION

1. Field of the Invention

The invention relates generally to apparatus for and methods of making asphaltic product, for example, asphalt paving material. More particularly, the invention relates to a combination of distinct pieces of equipment forming a production plant or system which is particularly adapted to utilize old asphaltic pavement comminuted as recycle aggregate in combination with other elements of asphalt paving material.

2. Discussion of the prior Art

Improvements in the cleanliness of asphalt material production Processes are items of constant concern to equipment manufacturers and to asphalt materials producers alike. In many instances, improvements leading to reduction in air pollution emanating from asphalt plants also tend to have detrimental effects on production volumes or other aspects of making the product.

For example, asphalt when heated above a certain temperature tends to vaporize. The vapor mixes with dust released during material drying operations and with hot drying gases. The vapor condensates when cooled and needs to be filtered out together with the dust before the drying gases are released into the atmosphere. If the concentration of hydrocarbon condensate becomes too great, state of the art filters tend to clog and downtime of the equipment results.

In one known production process using recycle material, the burners generating hot drying gases for drying the recycle material may be adjusted to burn at low flame temperatures to minimize the generation of hydrocarbons from the recycled asphalt. However, the relatively low flame temperatures are described as causing the generation of carbon monoxide. To rid the exhaust of carbon monoxide and hydrocarbons the gases are routed from the recycle drier to a drying drum of virgin aggregate material and there by special channels into a full combustion flame of the drying drum for the virgin material. The drying apparatus for the virgin aggregate is then used to burn the carbon monoxide as well as to break up hydrocarbons that may have formed during the drying of the recycle asphalt.

In the referred to apparatus, disclosed in U.S. Pat. No. 4,705,404, the output aggregate materials of the low temperature recycle material drying drum and of the high temperature virgin material drying drum are than discharged and transferred to a pugmill type mixer. In the pugmill, the aggregate materials are mixed and are further combined with liquid asphalt, also referred to as asphalt cement and with fines to complete the asphalt product. Hydrocarbons released during the mixing operation in the pugmill are not captured or burned.

In other drum drying and mixing apparatus at least some of the exhaust gases from the mixing apparatus have been returned to the burner to eliminate hydrocarbons from the exhaust of the apparatus. Apparatus of the latter type is disclosed in U.S. Pat. No. 4,600,379, where the virgin aggregate material is dried in an inner of two concentric drums and mixing takes place in an outer of such concentric drums. The recycle aggregate material is added from an external supply directly to the outer of the two concentric drums.

In that the concentricity of the two drums place the mixing operation into proximity of the heating operation for the virgin material, the mixing temperature tends to approach the temperature of the virgin material.

SUMMARY OF THE INVENTION

As improvement over certain prior art, it appears desirable to dry and pre-heat recycle aggregate material to an optimum temperature below that at which hydrocarbons are driven off from the recycle material or the recycle material otherwise deteriorates by oxidation, and without the generation of undesirable amounts of carbon monoxide.

It further appears desirable to be able to vary the mixture ratio of recycle material to virgin material in the asphalt product without need to significantly change the optimum temperature to which the recycle aggregate material is heated.

It is further desirable to minimize the generation of unwanted hydrocarbon vapors and to remove hydrocarbons released as vapors during mixing as well as during drying and heating recycle material.

It is, consequently, an object of the invention to provide a production plant or system including a number of pieces of known apparatus, and to combine such pieces of apparatus in a manner which heats recycle material to an optimum temperature separate from virgin material and which substantially eliminates heat loss from the recycle material in transferring the recycle material to a mixer for producing asphaltic product.

It is another object of the invention to allow a change in the temperature of virgin aggregate without a corresponding change of the temperature of the asphaltic mix and without change in the optimum pre-heat temperature of the recycle material predicated on a change in the mix ratio of recycle material to virgin material in the asphaltic product.

It is yet another object of the invention to remove exhaust containing hydrocarbons from both the recycle material drying operation and to subject them to the heat of an open flame.

Applicants in seeking to overcome problems of the prior art have found that polluting hydrocarbons are minimized when the total energy needed in the final asphalt product at a certain temperature is distributed as much as possible over all materials added to the final product.

Thus, recycle material which is often added to the product without or with insufficient heating needs to be heated to an optimum temperature as high as possible below the temperature at which the recycle material may deteriorate and give off polluting hydrocarbons. Drying of the recycle material requires heat which does not raise the temperature of the material to an undesirable level until significant moisture has been evaporated. After drying is complete, only small amounts of heat energy need to be added to raise the temperature of the recycle material to a desired temperature.

Typically the virgin aggregate material is heated to a temperature higher than the desired temperature of the final asphalt product. The additional heat energy provided by the "super-heated" virgin material is distributed during mixing to all materials in the final asphalt mix. Drying and pre-heating the recycle aggregate material reduces the heat energy that may need to be supplied by virgin aggregate material.

In accordance with the invention, an asphalt drum drying and mixing plant includes a parallel flow drum which has a first material drying region beginning at an upstream end of the drum. Adjacent and downstream from the material drying region is a mixing region which terminates at a material discharge end of the drum. The parallel flow drum further includes an intermediate material feed port which is located at an interface between the material drying and material mixing regions of the drum. A second drum of the plant is a counterflow drier drum which has opposite material feed and discharge ends and a burner assembly disposed at the material discharge end of the drum. The material discharge end of the counterflow drum is communicatively coupled to the intermediate feed port of the parallel flow drum to allow material discharged from the counterflow drum to be transferred through the intermediate material feed port into the parallel flow drum. Heated gases are introduced into the parallel flow drum at the material feed end thereof, are exhausted from the mixing region and are routed to a secondary air chamber of a burner assembly of the counterflow drum. The routing to the secondary air chamber has the effect of exposing the heated gases from both the drying and the mixing regions to be subjected to the heat of the flame of the burner assembly of the counterflow drum before the gases are exhausted therefrom to be routed to a dust separator or filter or similar cleaning apparatus before being vented to the atmosphere.

Recycle material is introduced into the material feed end of the parallel flow drum and enters the drying region of the drum. Heated gases are introduced at the feed end of the parallel flow drum to flow through the drum in the same direction as the general flow of material through the drum. The heated gases are generated by a burner assembly which is located adjacent the material feed end of the parallel flow drum. A combustion chamber is interposed between a burner head of the burner assembly and the drum, the combustion chamber allowing complete combustion of burner fuel to take place before the resulting heated gases enter the drying region of the parallel flow drum and come into contact with the recycle material.

CONSIDERATIONS RELATING TO THE INVENTION

When recycle material is introduced into the drying region of the parallel flow drum, the material typically contains some moisture. Upon initial contact with the heated gases, the moisture contents of the recycle material begins to evaporate, hence the material begins to dry. The material dries first before it can become heated further by the gases. However, the drying process also transfers energy from the heated gases to lower their temperature. The lowered temperature of the gases reduces the amount of heating of the recycle material once it is dry. The burner assembly generating the gases for the recycle pre-heater region desirably has a BTU per hour rating which is less than that of the corresponding burner assembly of the counterflow drum. The heat generation rate of the burner is furthermore adjusted to that necessary for preheating the recycle material to an optimum temperature below a temperature at which deterioration of the asphaltic material in the recycle material would occur.

The gases then advance toward the discharge end at the downstream end of the mixing region of the parallel flow drum. Any hydrocarbon vapors which may be emitted from heated asphalt cement are exhausted from the mixing region and routed to the secondary air chamber of the burner assembly of the counterflow drum, from where the gases move along the plume of the flame of the burner generating hot gases for heating the virgin material.

In the counterflow drum, the hot gases generated by the burner assembly of relatively greater heat generation capacity flow from a most heated state to a cooled state past the virgin aggregate materials. The virgin material being fed into the counterflow drum are contacted by the already cooled gases to initiate the drying process. As the material advances downstream (the direction of material flow within the drum, and counter to that of the gas flow) in a typical drying curtain of material, the material continues to dry as the temperature of the gases becomes higher and higher, until the material passes in an opened curtain laterally past the plume of the flame of the burner assembly. In the exposure of the virgin material to the hottest gases and the radiating heat from the flame, the material is capable of being heated in excess of the temperature of the final mixed asphalt product. Such excess heating is preferably monitored and controlled to heat the final mixed product to a desired temperature without the need to change the temperature to which the recycle material is heated.

Consequently, an increase in the mix ratio of recycled aggregate material to virgin aggregate material preferably may require an increase in the temperature of the virgin material to be mixed Such an increase may be deemed necessary to transfer substantially the same energy through less virgin material to maintain the temperature of the final mixed asphalt product as before the change in the ratio of the mix.

BRIEF DESCRIPTION OF THE DRAWINGS

The Detailed Description of a preferred embodiment should be read in reference to the accompanying drawings wherein.

DETAILED DESCRIPTION OF A PREFERRED EMBODIMENT OF THE INVENTION

Figure 1:
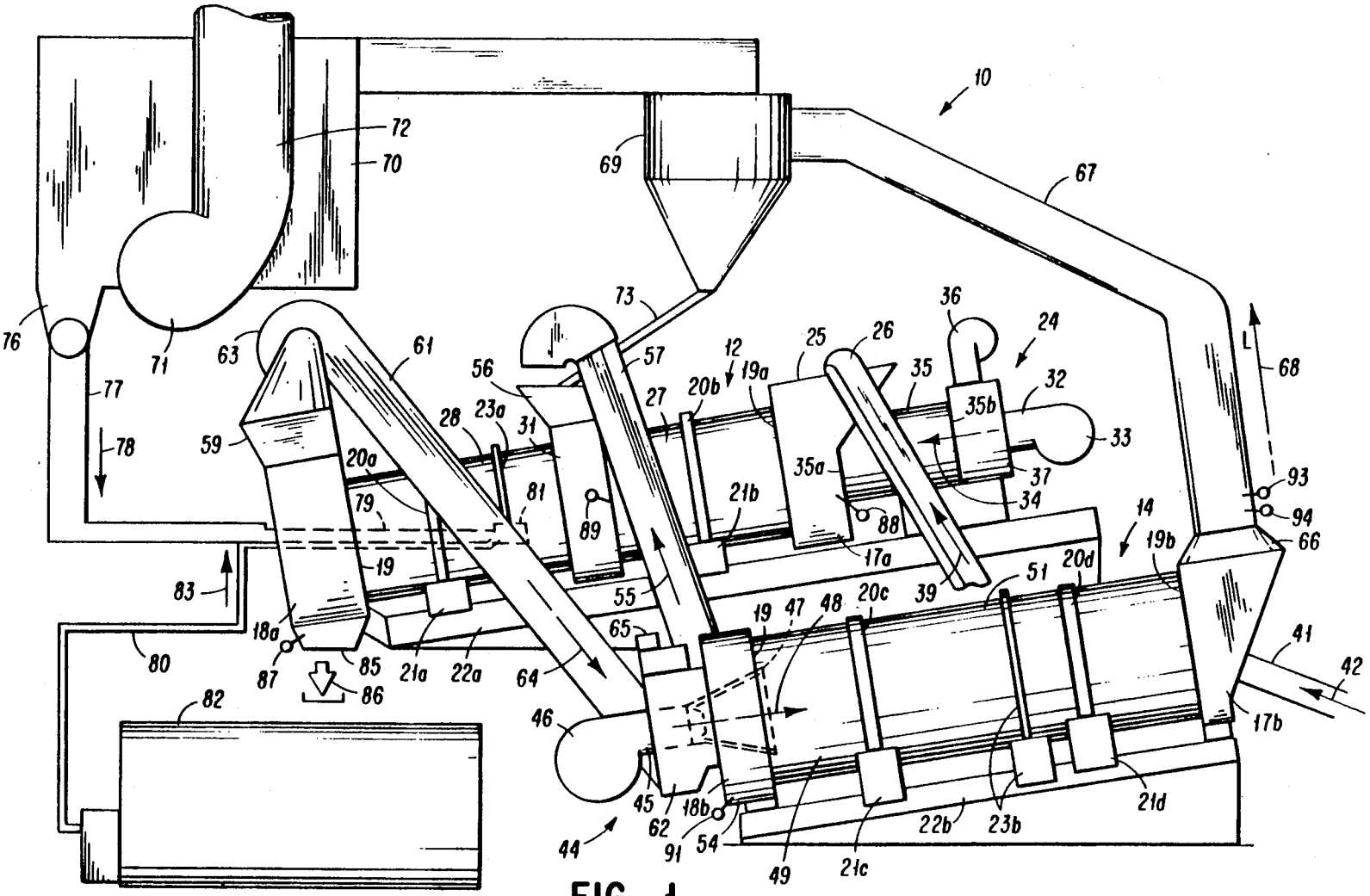
FIG. 1 is a schematic representation of an asphalt production plant which depicts the features of the present invention.

Referring now to the drawing which is entitled FIG. 1, there is shown a schematic representation of an asphalt production facility or asphalt production plant which is designated generally by the numeral 10. The production plant as described herein is particularly adapted to utilize the material of existing asphalt pavements which is typically crushed or broken into convenient size material. The sized asphalt pavement is then used as recycled asphalt pavement (RAP) as recycle aggregate material in the production of asphalt paving material or the like. Typically the recycle aggregate material is also mixed with virgin aggregate material (VAM) which is then in a heated condition mixed with heated liquid asphalt cement (AC) and fines to complete the production cycle. The resulting hot asphalt material is typically trucked to paving machines.

The drawing shows the combination of two cylindrical drums 12 and 14, of the type which are known in the art relating to asphalt production as a drum drier-mixer and a drum drier, respectively When set up for operation, both drums 12 preferably might be blocked up to operate at a slight incline, such as between five and ten degrees, for example. Opposite ends of the drums 12 and 14 are identified as material feed ends (17*a*, 17*b* of the respective drums 12,14) and material discharge ends (18*a*, 18*b* of the respective drums 12,14) The respective end 17 and 18 are typically stationary structures which substantially close off the otherwise open ends of the drums 12 and 14. Circular seals (19*a*, 19*b* of drums 12,14 respectively) between the respective structures of the ends (17*a*, 17*b* and 18*a*, 18*b* of drums 12 and 14) allow rotation of the drums 12 and 14 about longitudinal axes. When blocked up at an angle as shown schematically in the drawing, the upper end in each instance are the material feed ends 17 at which the aggregate materials are introduced into the respective drums 12 and 14. The feed ends of the drums are also referred to as the upstream ends. As is the custom, the terms "upstream" and "downstream" are used in reference to the flow of aggregate material through the drums in distinction to the flow of gases through the drums. The drums 12 and 14 would both be supported for rotation about longitudinal axes through the respective drums on peripheral tires (20*a*, 20*b* of drum 12, and 20*c*, 20*d* of drum 14) which rotate on trunnion assemblies (21*a*, 21*b* of drum 14, and 21*c*, 21*d* of drum 14) mounted to frames (22*a*, 22*b* in its place; of the respective drums 12 and 14. A typical sprocket and saddle chain drive is indicated at 23*a* with respect to drum 12 and at 23*b* with respect to drum 14.

The structures referred to as the ends 17*a*, 17*b*, and 18*a* and 18*b* may also be modified to admit or collect air or gases as may be further described herein. The material feed ends 17*a* and 17*b* would also include access for feeding material into the respective drums, while the material discharge ends 18*a* and 18*b* typically include material discharge chutes for discharging the material from the drums. Within the drums 12 and 14, the material is moved by a combination of well known flighting and gravity. Of the various types of flighting (not shown) used in asphalt mixing and drying drums, lifting flights raise the aggregate materials and allow it to drop and scatter it in form of a curtain or veil of falling material, filling substantially the entire volume of the respective drum. Heat shield flights lift the material but do not allow it to drop until the material has been rotated by the drum well past the top center of rotation. Heat shield flighting is used in a flame region of a drum. The material receives heat by radiation in such region, protecting at the same time the wall of the drum from the heat of the flame. Mixing flights are used in mixing regions of a drum. Mixing flights churn the materials without much lifting to mix the materials while the materials move slowly toward the discharge end of the respective drum.

Referring now particularly to the drum 12, the location of a burner assembly 24 identifies the drum 12 as a parallel flow drum through which gases, in this case heated gases, move in the same direction as the material fed into the drum. A feed hopper and chute or simply hopper 25 is shown at the top of the structure of the material feed end 17*a* of the drum 12. In the described embodiment, recycled asphalt pavement material is introduced through a conveyor 26, for example, and through the hopper 25 at the feed end 17*a* into the drum 12. The region adjacent the feed end 17*a* is a drying region 27. The materials introduced into the drying region would typically migrate slowly in a veil of falling material downstream toward the discharge end 18*a* of the drum 12. A second region of the drum 12 is a mixing region 28 into which the recycle material or RAP is directly transferred upon leaving the drying region 27. Thus, to the extent that the RAP is heated to a preferred and predetermined temperature, no cooling will take place while the RAP is transferred from being pre-heated into the mixing region 28.

The drum 12 also has an intermediate feed port 31 which is preferably located along the longitudinal axis of the drum 12 at the interface between the drying region 27 and the mixing region 28. Such intermediate feed port is known in the art and is disclosed, for example, in U.S. Pat. No. 4,395,129 to Joseph E. Musil. In prior art apparatus, such an intermediate feed port has been used to introduce RAP into a drum at a distance away from the source of hot gases when the gases have already transferred energy to the VAM introduced at the feed end of such prior art drier mixer apparatus.

The heated gases introduced at the feed end 17*a* of the drum 12 are supplied by a first turbo burner unit 32 of the burner assembly 24. The turbo burner unit 32 may be comparatively small in terms of heat generating capacity, a unit having a maximum energy output of ninety million BTU per hour being preferred The burn rate of such a burner is adjustable downward from such a maximum rating. The primary air is forced into the burner nozzle by means of a typical centrifugal compressor 33. The ignited fuel proceeds from the flame holder of the burner unit 32 into in the direction of an arrow 34 into an elongated, cylindrical combustion chamber 35. An inner end or opening 35*a* of the combustion chamber 35 communicates with the drum 12, and an outer end or opening 35*b* of the chamber 35 is coupled to the burner assembly 24. The wall of the combustion chamber 35 may be lined with refractory material or may be of heat resistant stainless steel. The length of the combustion chamber 35 is chosen to be sufficient that no luminous gases will enter the drum 12. Thus, the combustion process of the fuel, whether natural gas, LP gas, oil, or even coal, will be complete. It is particularly pointed out, that the compressor 33 supplies under all combustion settings and conditions a sufficient amount of primary air to assure complete combustion of the supplied fuel. Secondary air may be supplied if desired through a secondary air chamber 37 and may even be forced by a blower unit 38. Generally, however, it may be desirable to limit the amount of air flow into the drum 12 to the heated gases supplied by the burner unit 32.

Typically the heated gases contact freshly introduced RAP which contains at least some water. An arrow 39 indicates the direction of material feed of RAP through the conveyor 26 and via the hopper 25 into the feed end 17*a*. As the heated gases contact the RAP, moisture is evaporated while the heated gases cool, thereby reducing the energy left in the gases. Some of the energy from the heated gases is also transferred directly to the RAP, heating the material to an elevated temperature closer to the final temperature of the mixed product.

Referring now to the drum 14, the drum is used to dry and heat virgin aggregate material or VAM before the VAM is introduced through the intermediate feed port 31 into the drum 12. A feed conveyor 41, such as a slinger conveyor, for example, feeds the VAM in the direction of an arrow 42 into the feed end 17*b* of the drum 14. A burner assembly 44 of the drum 14 is located at the discharge end 18*b* of the drum 14, identifying the drum 14 as a counterflow drum. In a counterflow drum the hot gases generated move through the drum against the direction of general movement of the aggregate material through the drum. The burner assembly includes a turbo burner unit 45. Forced primary air is supplied to the burner unit 45 by a turbo compressor 46. An ignition port 47 shields the discharge end 18*b* of the drum 14 as the burner generates hot gases which enter the drum 14 in a direction of an arrow 48. In a flame region 49 within the drum 14, the material is caused to remain against the wall of the drum 14 thereby being further heated by radiant heat from the flame of the burner while protecting the drum 14 from such radiant heat. Upstream from such flame region 49, a material drying and heating region 51 may be equipped with typical and well known lifting or basket flights (not shown) which cause the material to be lifted and dropped substantially evenly across the interior section of the drum 14 in a veil of material. The hot gases pass through this veil of material, drying and heating the VAM. In a preferred embodiment the burner unit 45 may have a maximum energy generating capacity of, for example, two hundred million BTU per hour. Of course, this is a maximum heat generation capacity which can be adjusted downward. Again at all settings and conditions complete combustion is desired. With such heating capacity, super heating of the VAM is possible. VAM being not subject to deterioration can be heated to much higher temperatures than the RAP. For example, it may be possible to heat the VAM to a temperature in excess of 500 degrees Fahrenheit. At such temperature contact of the VAM with asphalt cement or AC is likely to cause the generation of unwanted hydrocarbon vapors. Consequently, the pre-heating of the RAP as described reduces the need to use the VAM as a major contributor of heat to the final asphalt mix.

The heated VAM is discharged from the drum 14 at the discharge end 18*b* into a discharge hopper 54 and is transferred from there toward the intermediate feed port 31 of the drum 12, as indicated by an arrow 55. The intermediate feed port 31 has at its top a hopper 56. A conveyor 57 transfers the VAM from the discharge hopper 54 to the hopper 56 of the feed port 31. The VAM enters the drum 12 through the feed port 31 and immediately begins to mix with the RAP, as the RAP and the VAM enter the mixing region of the drum 12. In that the VAM may cool somewhat while being transferred to the drum 12, such cooling can be compensated for by judiciously heating the VAM to a temperature slightly above that at which the VAM is intended to mix with the RAP. Since the temperature to which the VAM may be heated does not have the constraints which apply to heating the RAP, adjusting the temperature of the VAM as described to anticipate possible cooling would present no problem to the described production plant 10. The conveyor 57 may consequently be any of a number of conveyors available for material transfer. A typically insulated conveyor 57 to minimize such heat loss particularly in colder climates may be desirable. An important factor in controlling the quality of the mix, however, is the direct transfer of the RAP without cooling to the mixing region 28.

Though the careful adjustment of temperatures as described up to now minimizes the generation of hydrocarbon vapors, it may nevertheless be preferred to exhaust the gases from the discharge end 18*a* of the drum 12 to the discharge end 18*b* of the drum 14. To that extent, an exhaust chamber 59, mounted to the discharge end 18*a* of the drum 12 is further coupled to a transfer duct 61 which in turn is coupled to a secondary air chamber 62 of the burner assembly 44. A blower unit 63 may be installed in the transfer duct 61 between the exhaust chamber 59 and the secondary air chamber 62 to aid in the exhausting and transfer of the gases from the mixing region 28 into the drum 14 as indicated by an arrow 64. A secondary air bypass inlet 65 may be used to provide additional secondary air as needed. The transfer of the gases from the drum 12 into the secondary air chamber 62 causes the gases to pass along the perimeter of the flame of the burner unit 45, the heat decomposing and burning substantially those hydrocarbon vapors which may have been generated despite carefully selected temperatures for the aggregates entering the mixing region 28. Another advantage is the common route for exhausting all of the generated gases through an exhaust chamber 66 and transfer ducts 67 in a direction of an arrow 68 to typical decontamination and cleaning apparatus For example, a cyclone separator unit 69 may be coupled into the ducting 67 to precede a typical baghouse filter 70. After having passed through the baghouse filter 70, the gases have undergone a cleaning process and are exhausted by a main exhaust fan 71 through a stack 72 into the atmosphere.

Material separated by the cyclone separator 69 may be reintroduced conveniently through a material conveyor, such as a screw conveyor 73, through the hopper 56 into the mixing region 28. Fines are also collected in a collection trough 76 of the filter 70 and may be introduced into the mixing region 28 through fines delivery ducts 77 in transfer apparatus which typically uses forced air to drive the fines through the ducting as indicated by arrow 78. The delivery ducts 77 are coupled to a feed tube 79 which leads together with a feed pipe 80 for asphalt cement to a delivery point 81 within the mixing region 28. The asphalt cement is preferably heated in a supply tank 82 to a temperature below the vaporization temperature of the AC and is carefully metered in being pumped through the feed pipe 80 into the mixing region 28 as indicated by arrow 83.

When the mixed asphalt material is discharged from the drum 12 through a discharge chute 85 as indicated by an arrow 86, a temperature probe 87 as, for example, a thermocouple may be used to measure the final temperature of the mixed product. Other temperature checks may be used in controlling the temperatures of the aggregates as indicated. For example at the feed end 17*a* of the drum 12 a thermocouple 88 may be used to sense the temperature of the heated gases entering the drum 12. An output of the thermocouple 88 may be used to control the burner assembly 24. A third temperature probe or thermocouple 89 may be used to measure the temperature of the heated gases in the drum 12 as the gases leave the drying region 27 of the drum 12 and enter the mixing region 28. Another thermocouple 91 is preferably placed into the discharge hopper 54 to measure the temperature of the dry VAM. In addition to the described measuring points in the described apparatus, it may be desirable to measure and control the exhaust temperature of the hot gases before the gases enter the cleaning apparatus. A minimum temperature of for example three hundred degrees Fahrenheit may be desirable at the exit from the exhaust chamber 66 from the drum 14. Two thermocouples, a first fast acting thermocouple 93 and a second, comparatively slower acting thermocouple 94 may be used in measuring a difference between the two thermocouples 93 and 94 to establish a rate of change and initiate a change in material flow or in the heat generation of the burner assembly 44 as desired.

Various changes and modifications in the structure of the described embodiment are possible without departing from the spirit and scope of the invention which is sought to be defined by the claims herein and their reasonable equivalents.

What is claimed is:

1. An asphalt drum drying and mixing plant for drying, heating and mixing recycle and virgin aggregate materials to produce an asphaltic product, comprising:

means for drying and heating the recycle material to a first temperature, and for mixing the dried and heated cycle material with virgin aggregate material, including a parallel flow drum having a feed and hot gas intake end, a drying region adjacent said feed and hot gas intake end for drying and heating the recycle material to the first temperature, and a mixing region adjacent and downstream of the drying region for receiving the recycle material at the first temperature directly from the drying region, a material discharge end at a downstream end opposite said feed and hot gas intake end, and having an intermediate material intake port intermediate the opposite ends of the parallel flow drum, the feed and hot gas intake end including an end closure and a first material feed hopper and chute at the end closure for directing the recycle material from the first feed hopper and chute into said parallel flow drum;

means for introducing hot gases at the feed and hot gas intake end into the parallel flow drum, said hot gas introduction means including a combustion chamber communicating with said parallel flow drum and a burner assembly coupled to the combustion chamber, for delivering combustion gases into the combustion chamber for complete combustion of said gases within said combustion chamber prior to introduction of the gases from said combustion chamber into said parallel flow drum;

means for drying and heating the virgin aggregate material to a second temperature, including a counterflow drum having a material drying region, material feed and discharge ends respectively at opposite ends of said counterflow drum and a burner assembly; and means for transferring the dried and heated virgin aggregate material discharged from the discharge end of the counterflow drum to the intermediate material intake port of the parallel flow drum to be mixed within the mixing region of the parallel flow drum with the recycle material.

2. An asphalt drum drying and mixing plant according to claim 1, wherein the counterflow drum includes a secondary air chamber adjacent the material discharge end, wherein the plant further comprises means for exhausting and for routing exhaust gases from said parallel flow drum to the secondary air chamber of the counterflow drum including a parallel flow drum exhaust chamber disposed at the discharge end of the parallel flow drum, and ducting coupling said parallel flow drum exhaust chamber to said secondary air chamber of the counterflow drum.

3. An asphalt drum drying and mixing plant according to claim 2, further comprising means for drawing exhaust gases from said parallel flow drum exhaust chamber and for forcing said exhaust gases into said secondary air chamber of the counterflow drum.

4. A plant for producing a hot asphaltic material from virgin aggregate and recycle materials, comprising:

a parallel flow drum having a material feed end for receiving recycle material, a drying region adjacent said recycle feed end and a mixing region adjacent and downstream of the drying region, a material discharge end at a downstream end of said parallel flow drum opposite said recycle feed end, and an intermediate material intake port at an interface of the drying and mixing regions;

means for generating hot gases disposed adjacent said recycle feed end, said gas generating means being communicatively coupled at said recycle feed end to said parallel flow drum to introduce hot gases into said drum;

a counterflow drum having a material feed end at one end of the drum for receiving aggregate material, a material discharge end opposite the feed end for discharging such aggregate material from the drum and a burner assembly including a secondary air chamber disposed at said material discharge end of the counterflow drum for generating hot gases at said discharge end of the counterflow drum for drying and heating the aggregate material;

means for transferring the dried and heated aggregate material discharged from said discharge end of said counterflow drum to the intermediate material intake port of the parallel flow drum for introduction of the material discharged from said counterflow drum through such intermediate material intake port into the mixing region of the parallel flow drum, to be mixed with the recycle material into hot asphaltic material and contribute heat energy to the mixed material; and means for exhausting the hot gases from the mixing region at the material discharge end of the parallel flow drum and for routing said exhausted gases into the secondary air chamber at the material discharge end of the counterflow drum, whereby any hydrocarbon vapors exhausted from the mixing region of the parallel flow drum may be burned by the burner assembly within the counterflow drum.

5. A plant for producing a hot asphaltic material according to claim 4, wherein the burner assembly of the counterflow drum has a first heat generating capacity, the means for generating hot gases disposed adjacent the recycle feed end of the parallel flow drum comprising a combustion chamber communicating with the recycle feed end and a burner unit coupled to the combustion chamber and having a second heat generating capacity less than the first heat generating capacity of the burner assembly of the counterflow drum.

6. A plant for producing a hot asphaltic material according to claim 4, wherein the means for generating hot gases includes a burner unit having an adjustable burn rate, the plant further including a temperature probe disposed at the end of a downstream end of the drying region of the parallel flow drum to measure the temperature of the gases leaving the drying region for controlling the temperature of the hot gases to heat the recycle material to a first temperature, the plant further comprising means for determining a temperature of material discharged at the material discharge end at the downstream end of the parallel flow drum, and the burner assembly of the counterflow drum having an adjustable heat generating capacity for changing the temperature to which the aggregate material transferred to the intermediate material intake port is heated, whereby an adjustment of the heat generated by the burner assembly of the counterflow drum is adapted to control the temperature of the material discharged at the material discharge end of the parallel flow drum.

7. A plant for producing a hot asphaltic material according to claim 4, wherein the means for generating hot gases disposed adjacent the recycle feed end of the parallel flow drum comprises a burner assembly including a burner unit having an adjustable burn rate for controlling the heat generated by the hot gas generating means, the plant further including a temperature probe disposed to measure the temperature of the gases leaving the drying region of the parallel flow drum, whereby the temperature of the recycle material is controllable to an optimum temperature below a temperature at which the recycle material deteriorates.

8. A plant for producing a hot asphaltic material according to claim 7, wherein the heat generating capacity of the burner assembly of the counterflow drum is adjustable, the plant further comprising means including a temperature probe disposed at the discharge end of the counterflow drum for measuring the temperature of the dried and heated aggregate discharged from the counterflow drum, whereby the temperature of the aggregate material transferred to the intermediate material intake port is measurable and adjustable upon a change in the ratio of the aggregate material to the recycle material to maintain the temperature of the final mixed asphalt product as before the change in the ratio of the mix.

* * * * *

UNITED STATES PATENT AND TRADEMARK OFFICE

CERTIFICATE OF CORRECTION

PATENT NO. : 5,090,813

DATED : February 25, 1992

INVENTOR(S) : McFarland, Musil

It is certified that error appears in the above-identified patent and that said Letters Patent is hereby corrected as shown below:

Column 5, Line 21, "rotate on trunnion assemblies (21a, 21b of drum 14 and" should read --rotate on trunnion assemblies (21a, 21b of drum 12 and --.

Column 5, Lines 22 and 23, "21c, 21d of drum 14) mounted to frames (22a, 22b in its place; of the respective drums 12 and 14." should read --21c, 21d of drum 14) mounted to frames (22a, 22b of the respective drums 12 and 14).--

Signed and Sealed this

Twenty-ninth Day of June, 1993

*Attest:*

Michael K. Kirk

MICHAEL K. KIRK

*Attesting Officer*

*Acting Commissioner of Patents and Trademarks*